US007014229B1

(12) United States Patent
Stelmach

(10) Patent No.: US 7,014,229 B1
(45) Date of Patent: Mar. 21, 2006

(54) DOOR STOP AND HOLDER APPARATUS

(76) Inventor: John Stelmach, 740 6th St., Prescott, AZ (US) 86301

( * ) Notice: Subject to any disclaimer, the term of this patent is extended or adjusted under 35 U.S.C. 154(b) by 0 days.

(21) Appl. No.: 10/643,252

(22) Filed: Aug. 19, 2003

(51) Int. Cl.
*E05C 17/44* (2006.01)

(52) U.S. Cl. ..... 292/342; 292/DIG. 15

(58) Field of Classification Search ..... 292/342, 292/343, 339, 288, 289, 292, DIG. 15, DIG. 19; 16/82
See application file for complete search history.

(56) References Cited

U.S. PATENT DOCUMENTS

| | | | | | |
|---|---|---|---|---|---|
| 370,699 | A | * | 9/1887 | Hardin | 292/3 |
| 866,565 | A | * | 9/1907 | Bellamy | 292/342 |
| 1,542,888 | A | * | 6/1925 | Iverson | 292/342 |
| 1,605,422 | A | * | 11/1926 | Benedict | 292/343 |
| 2,376,117 | A | * | 5/1945 | Bright et al. | 292/343 |
| 3,636,727 | A | | 1/1972 | Naughton | 62/409 |
| 3,737,186 | A | | 6/1973 | Chezem | 292/338 |
| 4,907,832 | A | * | 3/1990 | Pemberton | 292/228 |
| D309,708 | S | | 8/1990 | Rosa et al. | D8/402 |
| 5,123,548 | A | * | 6/1992 | Milne | 211/69.5 |
| 5,280,977 | A | * | 1/1994 | Piva | 292/296 |
| 6,135,516 | A | | 10/2000 | Gasperino | 292/343 |
| 6,345,849 | B1 | * | 2/2002 | Yen | 292/343 |

* cited by examiner

*Primary Examiner*—Gary Estremsky
(74) *Attorney, Agent, or Firm*—Sturm & Fix LLP

(57) ABSTRACT

A door stop and holder apparatus (10) including a generally wedge shaped stop member (20) connected by a tether member (50) to a hollow receptacle member (40) the rear face (41) of which is affixed to a door (100) and the front face (42) of which is provided with at least one receptacle element (45) dimensioned to receive a portion of a bumper member (60) that projects outwardly from the front face (42) of the holster member (40).

11 Claims, 1 Drawing Sheet

DOOR STOP AND HOLDER APPARATUS

CROSS REFERENCE TO RELATED APPLICATIONS

Not applicable.

BACKGROUND OF THE INVENTION

1. Field of the Invention

The present invention relates to the field of door stop devices in general and in particular to a door stop and holder arrangement wherein, either the holder and/or door stop functions as a door bumper.

2. Description of Related Art

As can be seen by reference to the following U.S. Pat. Nos. 6,135,516; 2,376,117; Des. 309,708; 3,737,186; and, 3,636,727, the prior art is replete with myriad and diverse door securing or stopping arrangements.

While all of the aforementioned prior art constructions are more than adequate for the basic purpose and function for which they have been specifically designed, they are uniformly deficient with respect to their failure to provide a simple, efficient, and practical combined door stops and holder apparatus wherein, the door stop is tethered to the holder so as not to be displaced or lost, and wherein, in two different versions of the invention, the doorstop per se or in combination with the holder, acts as a non-marking bumper for the door when it swings inwardly against a wall.

Unfortunately, none of the aforementioned prior art constructions have even remotely contemplated such a dual function arrangement in their design or structure.

As a consequence of the foregoing situation, there has existed a longstanding need for a new and improved dual purpose door stop and holder apparatus that safely immobilizes a door in a closed position and which also provides a cushioned bumper that prevents a door from marking an adjacent wall when fully opened and, the provision of such an apparatus is the stated objective of the present invention.

BRIEF SUMMARY OF THE INVENTION

Briefly stated, the door stop and holder apparatus that forms the basis of the present invention comprises in general a stop unit and a holder unit wherein, the stop unit is operatively connected to the holder unit via a tether member.

As will be explained in greater detail further on in the specification, the stop unit comprises a generally wedge shaped stop member preferably fabricated from hard rubber or the like.

The holder unit comprises a complementary shaped hollow holster member dimensioned to receive a portion of the tapered end of the stop member.

In addition, the holster member has a vertically angled rectangular rear face adapted to be secured to the outer and lower portion of the rear face of the free end of a conventional door so that the stop member can be deployed in its normal fashion.

Furthermore, the angled rectangular front face of the holster member is provided with a pair of generally hollow cylindrical receptacle elements that are dimensioned to receive the opposite ends of a generally cylindrical resilient bumper member that may be deformed into a generally U-shaped configuration that projects outwardly from the front face of the holster member wherein, the stop member is further provided with a flexible tether member that is also attached to one of the exterior faces of the holster member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
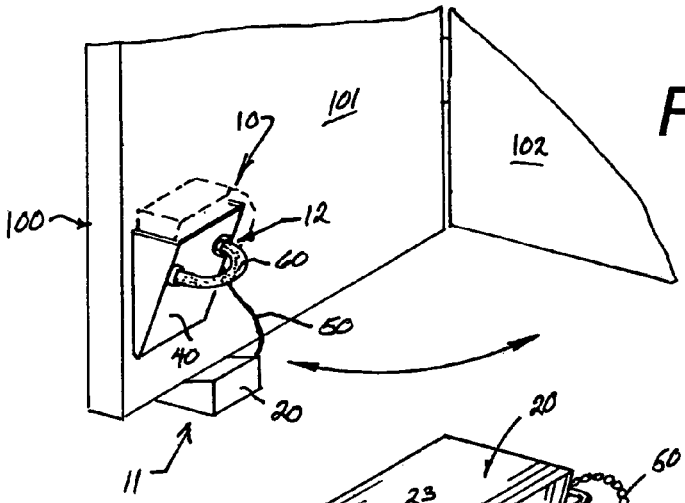
FIG. 1 is a perspective view of the holster member secured to the rear of a door and the stop member engaged with the bottom of the door.

As can be seen by reference to the drawings, and in particular to FIG. 1, the door stop and holder apparatus that forms the basis of the present invention is designated generally by the reference number 10. The apparatus 10 comprises in general a stop unit 11, and a holder unit 12. These units will now be described in seriatim fashion.

Figure 3:
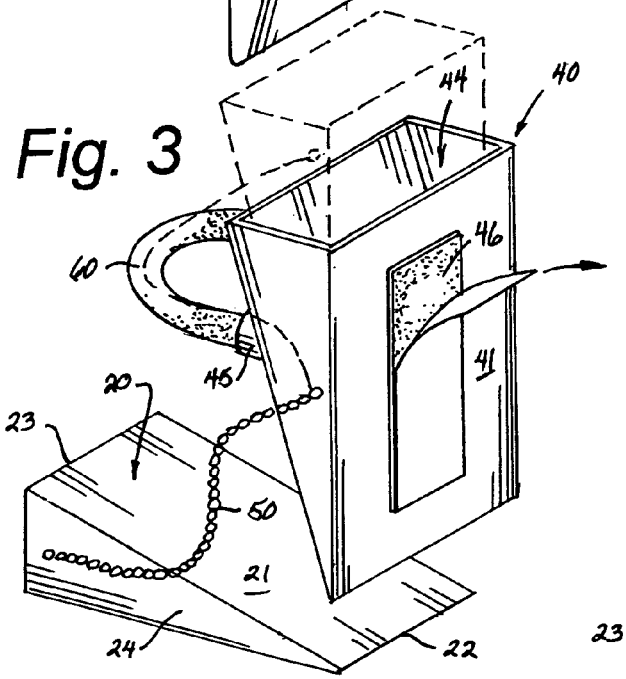
FIG. 3 is a rear perspective view of the apparatus showing the adhesive strip used to mount the holster member on a door; and, FIG. 4 is a side elevation view of the holster member and stop member operatively associated with a door.
Figure 4:
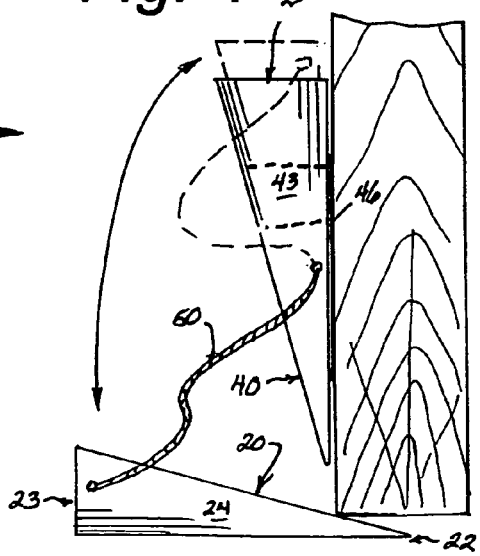

As shown in FIGS. 3 and 4, the stop unit 11 comprises a generally wedge shaped stop member 20 fabricated from a hard rubber material 21 or the like wherein, the wedge member 20 has an enlarged end 22, a tapered end 23 and two opposed generally triangular shaped side walls 24.

Figure 2:
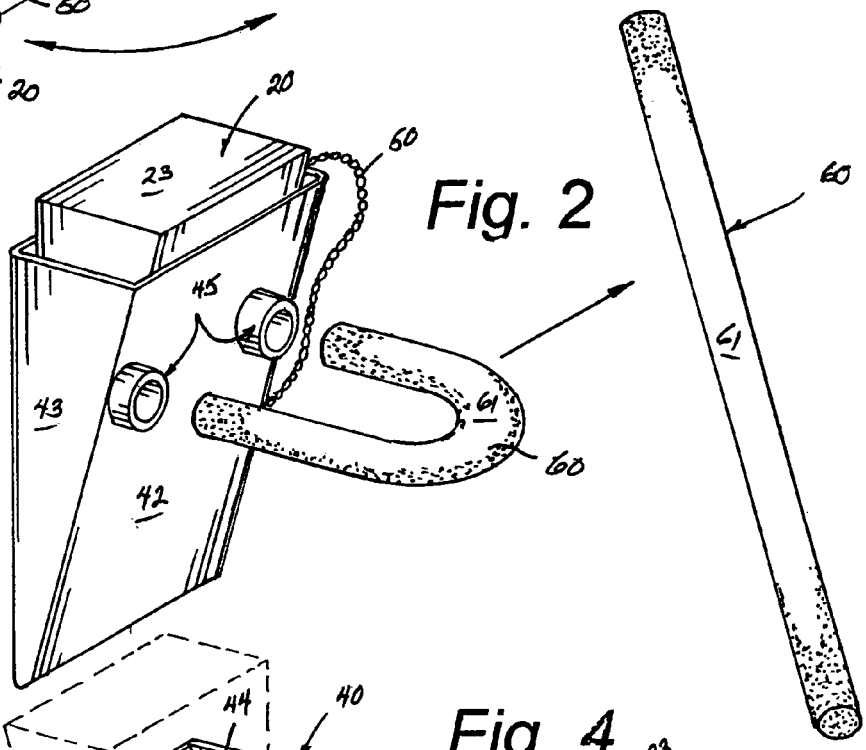
FIG. 2 is an isolated partially exploded perspective view showing the relationship of the bumper member with the front face of the holster member.

Turning now to FIGS. 2 through 4, it can be seen that the holder unit 12 comprises a generally hollow wedge shaped holster member 40 having a rectangular vertical rear face 41, a rectangular angled front face 42, and a pair of opposed generally triangular opposed side faces 43 wherein, the hollow interior 44 of the holster member 40 is dimensioned to releasably receive at least a substantial portion of the tapered end 22 of the stop member 20 wherein, a flexible tether member 50 is provided to operatively connect the stop member 20 to the holster member 40 to prevent the loss or misplacement of the stop member 20 relative to the holster member 40.

In addition, as can best be appreciated by reference to FIGS. 2 and 3, the angled front face 42 of the holster member 40 is provided with a pair of hollow cylindrical receptacle elements 45 that are dimensioned to receive the opposite ends of an elongated cylindrical bumper member 60 fabricated from a resilient material 61 that allows the bumper member 60 to be deformed into the generally U-shaped configuration depicted in FIGS. 2 and 3.

In this manner, the bumper member 60 projects outwardly from the front face 42 of the holster member 40 to initiate contact with any wall surface 102 within the arc of rotation of the door 100.

Furthermore, as can best be seen by reference to FIGS. 3 and 4, the rear face 41 of the holster member 40 is further provided with a strip of adhesive 46 for attaching the holster member 40 on the lower portion of the rear face 101 of the free end of the swinging door 100.

In an alternate version of the preferred embodiment depicted in FIG. 4, it can be seen that the height of the holster member 40 is relatively truncated as indicated by the dashed lines such that the enlarged end 23 of the stop member 20 will project beyond the top of the holster member 40 to serve either as a primary or auxiliary impact cushioning element.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A door stop and holder apparatus for doors wherein, the apparatus comprises a door stop unit including a generally wedge shaped stop member having an enlarged end and a tapered end; and, a holder unit including a hollow holster member dimensioned to receive and support a portion of the tapered end of the stop member wherein the holster member is further provided with a pair of hollow receptacle elements, and further includes an elongated bumper member having opposite ends that are dimensioned to be received in said pair of receptacle elements;

a tether member the opposite ends of which are connected to the holster member and the stop member; and, means for attaching the holster member to a vertical surface such as a door.

2. The apparatus as in claim 1; further including a tether member the opposite ends of which are connected to the holster member and the stop member.

3. The apparatus as in claim 1; wherein, the stop member is fabricated from a hard rubber material.

4. The apparatus as in claim 1; further including a bumper member formed of deformable resilient material wherein, a portion of the bumper member is dimensioned to be received in said at least one receptacle element.

5. A holster unit for use in combination with a conventional door stop having a wedge shaped configuration wherein, the holder unit comprises a hollow generally wedge shaped holster member having a rear face provided with means for attaching the holster member to a door surface; wherein, the holster member is further provided with a pair of hollow receptacle elements; and further includes an elongated bumper member having opposite ends that are dimensioned to be received in said pair of receptacle elements.

6. The holder unit as in claim 5; wherein, the hollow holster member has an opening that is substantially smaller than the external periphery of the largest end of the wedge shaped stop member.

7. A door stop and holder apparatus for doors wherein, the apparatus comprises a door stop unit including an enlarged generally wedge shaped resilient stop member having an enlarged end and a tapered end;

a holder unit including a truncated generally wedge shaped hollow holster member dimensioned to receive and support only the lower portion of the tapered end of the stop member; wherein, the upper portion of the stop member projects a substantial distance beyond the top of the holster member;

means for attaching the holster member to a vertical surface such as a door;

wherein, the holster member is provided with at least one hollow receptacle element; and further including a bumper member formed of deformable resilient material wherein, a portion of the bumper member is dimensioned to be received in said at least one receptacle.

8. The apparatus as in claim 7; wherein, the holster member is further provided with a pair of hollow receptacle elements.

9. The apparatus as in claim 8 further including an elongated bumper member having opposite ends that are dimensioned to be received in said pair of receptacle elements.

10. The apparatus as in claim 7; further including a tether member the opposite ends of which are connected to the holster member and the stop member.

11. The apparatus as in claim 9; further including a tether member the opposite ends of which are connected to the holster member and the stop member.

* * * * *